US005653608A

United States Patent [19]

Saligny

[11] Patent Number: 5,653,608

[45] Date of Patent: Aug. 5, 1997

[54] CONNECTOR WITH INSULATION DISPLACEMENT CONTACTS

[76] Inventor: Yves Saligny, 65 Allée du Docteur Jacques Arnaud, 74300 Thyez, France

[21] Appl. No.: 416,882

[22] PCT Filed: Sep. 5, 1994

[86] PCT No.: PCT/FR94/01042

§ 371 Date: Apr. 20, 1995

§ 102(e) Date: Apr. 20, 1995

[87] PCT Pub. No.: WO95/07560

PCT Pub. Date: Mar. 16, 1995

[30] Foreign Application Priority Data

Sep. 6, 1993 [FR] France ..... 93 10553

[51] Int. Cl.[6] ..... H01R 4/24

[52] U.S. Cl. ..... 439/404; 439/395

[58] Field of Search ..... 439/395–405, 439/417, 418

[56] References Cited

U.S. PATENT DOCUMENTS 4,822,298 4/1989 Gerke et al. ..... 439/402

4,891,018 1/1990 Afflerbaugh et al. ..... 439/402

FOREIGN PATENT DOCUMENTS

0075150A3 3/1983 European Pat. Off. .

0369688A3 5/1990 European Pat. Off. .

2650920A1 2/1991 France .

*Primary Examiner*—David L. Pirlot

*Attorney, Agent, or Firm*—Sughrue, Mion, Zinn, Macpeak & Seas

[57] ABSTRACT

The connector includes at least one insulation displacement contact (17) itself including two substantially coplanar arms (50A, 50B) delimiting a slot (52) between them.

It is characterized in that it further includes shaping means (73, 74A, 74B) for pressing the electrical conductor (15) against the two arms (50A, 50B) of the contact, on a first side in the case of one of the arms (50A) and on the opposite side in the case of the other arm (50B).

27 Claims, 5 Drawing Sheets

CONNECTOR WITH INSULATION DISPLACEMENT CONTACTS

The present invention is generally concerned with connectors including in an insulative body at least one insulation displacement contact, i.e. at least one contact which, for connecting an insulated or uninsulated electrical conductor, includes two arms delimiting between them a slot into which the electrical conductor is forced.

These connectors are used in receptacles, especially low-current receptacles, electrical appliances and telephone distribution frame and sub-distribution frame components such as cable terminations or cross-connect terminal strips.

In practice, these connectors include a plurality of parallel insulation displacement contacts.

One problem with manufacturing them is therefore to minimize their overall size and to make a reliable connection.

Document EP-A-0 014 081 describes a flat insulation displacement contact including three limbs defining two slots for the same conductor. To connect it the conductor is inserted slantwise between the two side limbs and the middle limb and forced along the two slots. The connection is reliable but requires a high insertion force to push the conductor along the two slots. The contact is relatively bulky.

Document EP-A-0 075 150 describes a multiple contact including a plurality of parallel contact branches fastened together and each connecting one conductor. Each contact branch includes a slot in which the connected conductor assumes an oblique position relative to the contact branch, for example a position at 45°. In each branch the two edges facing the slot are slightly bent on either side of the branch and separate the conductors in the slots which are connected together in parallel. On cross-connect terminal strips the pitch of the multiple branched contacts is relatively large and makes the terminal strip relatively bulky.

An object of the present invention is to reduce the overall size of the contacts in the insulative body of the connector and to increase the reliability of the connection between the conductors and the contacts.

The present invention consists in a connector including an insulative body and at least one flat insulation displacement contact mounted in a groove in said body, wherein each contact has an insulation piercing slot for connecting a conductor and two substantially coplanar arms on opposite sides of said slot, characterized in that it further includes means on opposite sides of said slot for shaping said conductor associated with each contact for connecting said conductor in the slot and pressing said conductor against opposite sides of the contact, on a first side in the case of one of the arms and on the opposite side in the case of the other arm.

This connector advantageously has at least one of the following additional features:

in a first embodiment of the invention, said means for shaping the conductor include on said contact two flats for engaging the conductor in the slot substantially symmetrically inclined on opposite sides of said arms and extending the respective arm at the end of said slot to receive and locate the conductor between them along a line substantially perpendicular to the direction of said slot.

said shaping means further include said slot in which said contact is mobile between two flanks of said slot from a position of engagement of the conductor between said flats to a position of connection of the conductor in said slot, the two facing flanks holding the conductor against said contact during placing of the latter in said connection position.

in one embodiment of the invention, said conductor shaping means include said groove in which said contact is fixed and which is long, open, delimited between two facing flanks which are substantially S-shape, at least locally and in a longitudinal direction of the groove, and each adapted to hold a first side of a first arm against a first of said flanks in a first end portion of said groove and the opposite or second side of the second arm against the second flank in the second end portion of said groove and to guide the conductor received in the longitudinal direction of the groove against the second side of the first arm and the first side of the second arm, before its engagement in said slot.

said flanks are substantially S-shape over the length of said groove which is also S-shape and each has two substantially parallel opposite end portions joined by a slantwise middle portion between the two end portions.

said flanks are substantially S-shape over one end portion of the groove for one flank and over the other end portion of the groove for the other flank.

each contact has an upstand on each arm over at least part of the length of the edge of the arm facing said slot and bent to an angle of not more than substantially a right angle one way on one of the two arms and the opposite way on the other arm, so that said contact is Z-shape in cross-section at their location.

each bent upstand is bent at an acute angle to the arm on which it is formed.

said contact further includes a set of three substantially aligned holes through each bent upstand and a part fastening the arms together beyond the slot in corresponding relationship to two further holes opening to the outside through said body.

The features and advantages of the invention emerge from the following description given with reference to the appended diagrammatic drawings, in which:

FIGS. 1 to 10 show by way of example the application of the invention to a "NUMERIS" type receptacle 10.

As this type of receptacle is not part of the present invention as such it is not fully described here.

Figure 7:
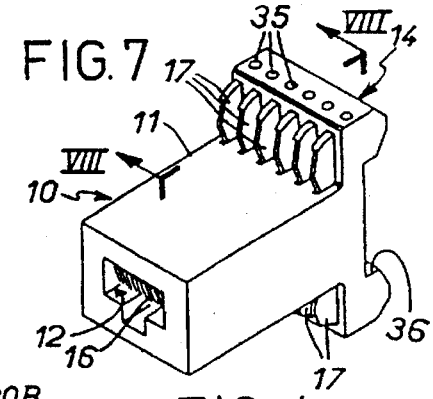
FIG. 7 is a perspective view of a receptacle using a connector of the invention.

Suffice to say that it has an insulative material body 11 forming a cell 12 at the front into which a complementary plug (not shown) can be inserted and a connector 14 at the rear for connecting a specific number of electrical conductors 15 (FIG. 7).

At least one contact blade 16 in the cell 12 is in corresponding relationship to a contact 17 in the connector 14.

In practice there are several parallel contact blades 16 in the cell 12 and the connector 14 has the same number of parallel contacts 17 each connected to a respective contact blade 16 and each receiving one or two insulated electrical conductors 15.

The insulated electrical conductors 15 have a conductive core 18 and a sheath 19.

The contacts 17 of the connector 14 are insulation displacement contacts, i.e. they include two arms 20A, 20B delimiting between them an insulation piercing slot 22 into which an electrical conductor 15 is forced. In the embodiment of the invention shown they are associated in pairs to constitute a double contact.

The two contacts 17 of a double contact are in practice parts of the same cut and folded blank. They share a bar 23 connecting them in parallel to the respective contact blade 16 and a hinge 24 in the form of a right-angle upstand in the middle of one edge of the blank. They lie on respective opposite sides of the bar 23 and the hinge 24.

The slot 22 in the contacts 17 is straight. It extends in a lengthwise direction D1 shown in chain-dotted line in FIG. 1 in the case of the one contact shown in full in that figure.

As described in more detail below, and in accordance with the invention, each contact 17 is associated with conductor shaping means on each side of the slot for connecting the conductor in the slot 22 and for pressing it against opposite sides of the contact 17, on one side in the case of one of the arms 20A, 20B and on the opposite side in the case of the other arm.

In FIGS. 1 to 13 the shaping means associated with the contact 17 include a flat 25 on each arm 20A, 20B and across the width of the latter for engaging the conductor. This flat is inclined to each arm at the end of the slot. The two flats 25 extend the arms and are symmetrically inclined on their opposite sides. They define on the contact a level line L1 substantially perpendicular to the direction D1 of the slot 22.

The flat 25 on each arm 20A, 20B is the lower part of a generally semicylindrical local deformation 26 whose generatrices are the level lines L1 and are therefore perpendicular to the lengthwise direction D1 of the slot 22. Their concave side faces one way on one of the arms 20A, 20B and the other way on the other arm. The concave sides of both deformations face the plane of the two arms.

In other words, in the case of the arm 20A, for example, the local deformation 26 is a convex projection on one side and in the case of the arm 20B it is a convex projection on the opposite side.

Figure 2:
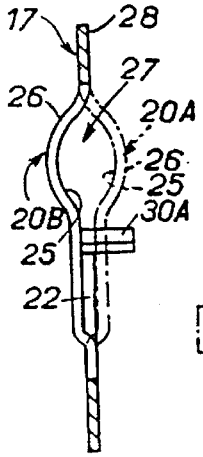
FIG. 2 is a view of this contact in transverse cross-section on the line II—II in FIG. 1.

Thus, as shown diagrammatically in FIG. 2, the local deformations 26 form a channel 27 at the end of the arms 20A, 20B extending the width of both arms in the direction perpendicular to the slot 22 and into which the electrical conductor 15 to be connected in the slot must be inserted.

Figure 1:
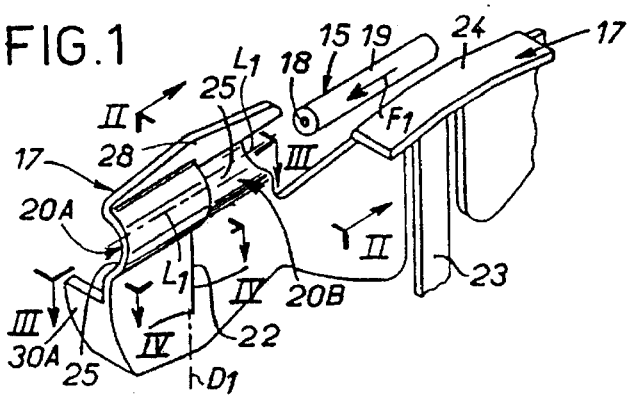
FIG. 1 is a perspective view of an insulation displacement contact which can be used in a connector of the invention.
Figure 5:
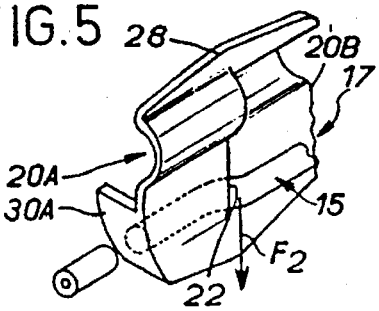
FIG. 5 is a perspective view, corresponding to part of FIG. 1, after insertion of an electrical conductor.

As a result of this, when the electrical conductor 15 is inserted longitudinally into the channel 27, in the direction of the arrow F1 in FIG. 1, and then forced transversely into the slot 22, in the direction of the arrow F2 in FIG. 5, it assumes an S-shape configuration of its own accord, extending against the arm 20A on the concave side of its local deformation 26 and against the arm 20B on the side of its local deformation 26, i.e. the opposite side (see FIG. 5).

In the embodiment of the invention shown in FIGS. 1 to 10 the two local deformations are linked by a bridge 28 at the end of the arms and along the channel 27.

This strengthens the assembly.

In practice the bridge 28 is substantially in the plane of the initial blank.

Also, in this embodiment of the invention, the slot is obtained merely by cutting the blank.

Figure 3:
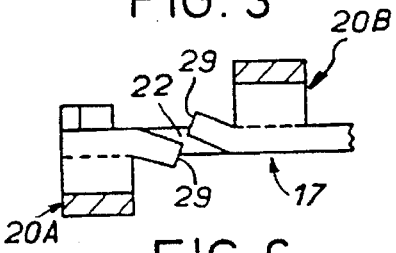
FIGS. 3 and 4 are partial views in longitudinal cross-section on the respective lines III—III and IV—IV in FIG. 1, to a different scale and with the thicknesses exaggerated.
Figure 4:
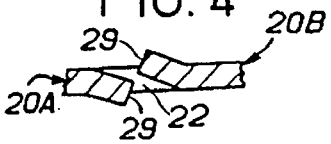

To facilitate the forcible insertion of an electrical conductor 15 the lips 29 of the slot 22 are preferably offset relative to each other transversely to the plane of the arms 20A, 20B, as seen most clearly in FIGS. 3 and 4.

Figure 6:
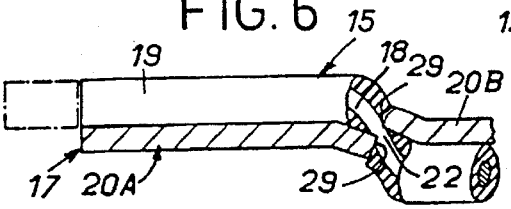
FIG. 6 is a partial view in longitudinal cross-section analogous to FIG. 4, after insertion of the electrical conductor.

The relative offset of the lips 29 of the slot 22 is in practice sufficient for a gap to remain between the lips 29 to facilitate the passage of the conductive core 18 of an electrical conductor 15, as shown in FIG. 6.

However, the lips 29, which are formed by the cut edge of the initial blank between the two arms, are generally perpendicular to the plane of the arms 20A, 20B and are the result of slight deformation of the facing edges of the arms on respective sides.

The thickness of the blank is deliberately exaggerated in FIGS. 3, 4 and 6. Also, the relative widths of the arms 20A, 20B are not to scale in these figures.

The arm 20A, which is the outermost arm relative to the hinge 24, is flanked by a right-angle upstand 30A forming a cutter on the concave side of the local deformation 26.

As shown in FIGS. 7 to 10 the contacts 17 are mobile in their own plane within the body 11, between a conductor insertion position (FIG. 8) in which they are adapted to receive the electrical conductors transversely and a connection position (FIG. 10) in which each conductor is forcibly inserted in the slot 22.

The shaping means associated with each contact 17 further include the flanks 32A, 32B of a groove 33 in the body 11 in which the contact 17 can move. These flanks hold the conductor against the arms of the contact during its movement to the connection position.

In the embodiment of the invention shown each contact 17 can rotate in the body 11 by virtue of deformation about the hinge 24.

Figure 8:
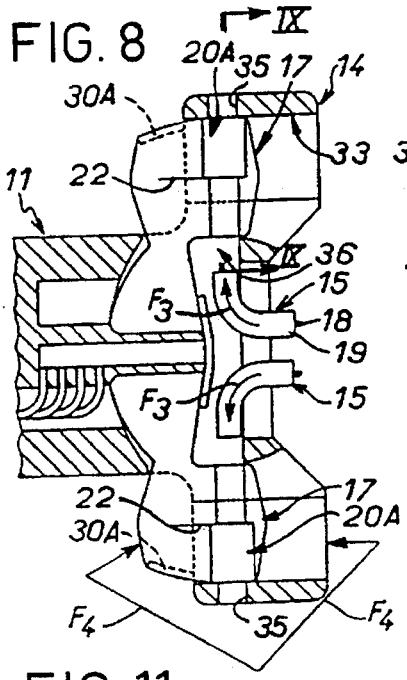
FIG. 8 is a partial view of this connector in longitudinal cross-section on the line VIII—VIII in FIG. 7.
Figure 9:
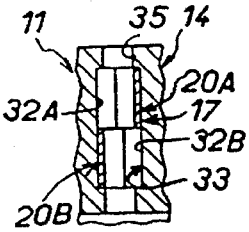
FIG. 9 is a partial view of the connector in transverse cross-section on the line IX—IX in FIG. 8.

Entry channels 36 for the conductors are provided on the rear or back of the body 11, in its recessed central area, for insertion of the electrical conductors 15 into the channel 27 of the contacts, in the direction of the bent arrows F3 in FIG. 8.

The body 11 includes holes 35 for the excess length of the electrical conductors 15 each opening into one groove 33 facing the channel 27 of the contact in the position of insertion in the groove.

The holes 35 are substantially aligned on an upper surface and a lower surface of the connector.

Finally, in the embodiment of the invention shown each of the contact members 17 projects from the body 11 in the position of engagement of the side opposite the entry channel 36 with the connector 14 (FIG. 8).

To facilitate pivoting of the contacts 17 they can be acted on by a clamp bearing against the back of the body 11, as shown by the scissors arrows F4 in FIG. 8. The clamp advantageously bears on the side of the contact members 17 strengthened by the right-angle upstand 30A forming a cutter.

In the engagement position shown in FIG. 8 the channels 27 of the contact members 17 are aligned with the holes 35 in the body 11.

As shown by the arrows F3 in FIG. 8, each of the electrical conductors 15 can be inserted into the entry channel 36 and pushed into the channel 27 of the contact member 17 and into one of the holes 35 in the body 11.

Figure 10:
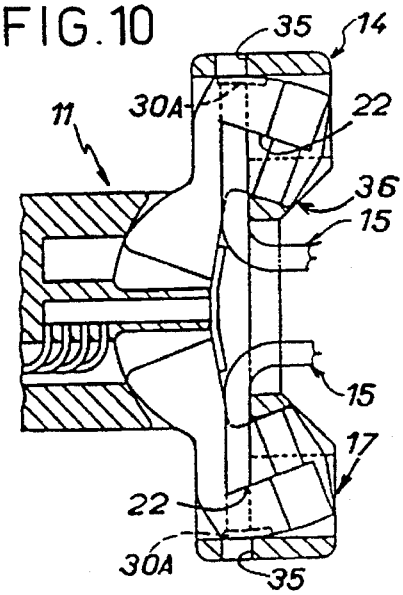
FIG. 10 is a partial view in longitudinal cross-section analogous to FIG. 8, after insertion of electrical conductors.

All that is then required to connect the conductors in the respective slots is to pivot the contacts 17 from their engagement position to the connection position shown in FIG. 10.

Because of the shaping means previously described, the electrical conductors 15 then each assume an S-shape configuration on opposite sides of the contacts 17 with which they are engaged, lying against one arm on one side and against the other arm on the opposite side.

They are cut at the same time by the right-angle upstand 30A forming a cutter and their surplus end piece removed, as shown diagrammatically in FIG. 5.

Figure 11:
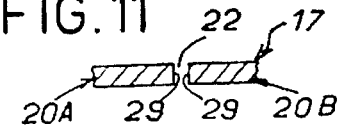
FIGS. 11 and 12 are partial views in longitudinal cross-section analogous to FIG. 4, each relating to a respective specific embodiment of the invention.

In the embodiment of the invention shown in FIG. 11 the lips 29 of the slot 22 in the contacts 17 are separated from each other in the plane of the arms 20A, 20B. They are substantially straight and perpendicular to the plane of the arms 20A, 20B.

Figure 12:
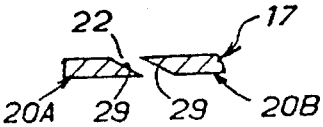

This is not so in the FIG. 12 embodiment of the invention, in which the lips 29 are oblique to the plane of the arms 20A, 20B.

Figure 13:
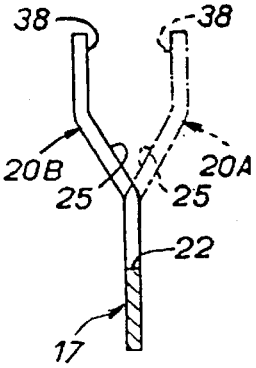
FIG. 13 is a view in transverse cross-section analogous to FIG. 2, for another embodiment of the invention.

In the FIG. 13 embodiment of the invention the deformations at the ends of the two arms 20A, 20B of the contact 17 extend freely on either side of the plane of the arms.

In other words, they are not linked together by any bridge. Also, in this embodiment of the invention each engagement flat 25 is substantially planar and oblique to the plane of the arms. It is preceded by an entry flat 38 which is also substantially planar and substantially parallel to the original plane of the blank and separated from the other flat by the entry 38.

In this embodiment of the invention the electrical conductor 15 to be connected can if required be inserted between the flats 38 and 25 in the lengthwise direction of the slot 22.

FIGS. 14 to 22 show by way of example the application of the invention to a telephone distribution frame or subdistribution frame component such as a cable termination or cross-connect terminal strip.

As before, this unit constitutes at least locally a connector 44 including in an insulative material body 41 at least one insulation displacement contact 47, in practice a plurality of parallel contacts 47 of this type.

Also as before, each contact 47 has two arms 50A, 50B delimiting a slot 52 between them for the forcible connection of an electrical conductor 15. Associated shaping means press the electrical conductor 15 against the arms 50A, 50B in a direction transverse to the lengthwise direction D1 of the slot 52, on a first side in the case of one of the arms 50A, 50B and on the opposite side in the case of the other arm.

Figure 20:
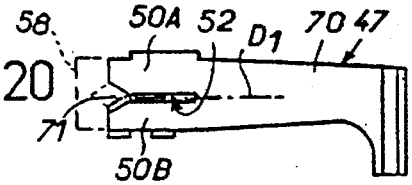
FIG. 20 is an elevation view of this insulation displacement contact as seen in the direction of the arrow XX in FIG. 19.

The two arms 50A, 50B of the contact 47 are formed from a one-piece blank and are attached to a common foot 70 on the blank. The slot 52 is preceded by an entry Vee 71 for the conductor, as shown in FIG. 20, at the end and open between the arms 50A, 50B. Alternatively, as shown in chain-dotted line in FIG. 20, the entry Vee 71 is closed by a bridge 58 at the end linking the two arms.

Figure 21:
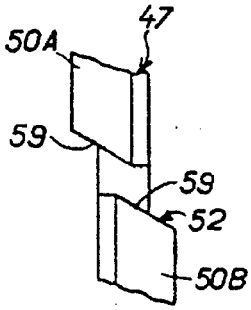
FIG. 21 shows to a larger scale the part of FIG. 19 inside the box XXI in FIG. 19.

The lips 59 of the slot 52 are offset to each other in a direction transverse to the plane of the arms 50A, 50B, as can be seen more clearly in FIG. 21, and are oblique to the plane of the arms 50A, 50B. They are slightly spaced apart in the plane of the arms 50A, 50B.

The shaping means associated with each contact 47 include, in the body 41, an S-shape groove 73 open along one wall 72, in practice a front wall, in which the contact is mounted with the lengthwise direction D1 of the slot 52 centred on the groove and extending towards the back of the groove.

The groove is delimited between two generally parallel flanks 74A, 74B each having an oblique middle portion between two straight end portions. The slot is between the two oblique portions of the two flanks.

The arm 50A is flanked locally by a right-angle upstand 60A forming a cutter.

The other arm 50B is flanked locally by at least one right-angle upstand 60B forming a wire-stop.

In practice there are two spaced right-angle upstands 60B forming wire-stops on the arm 50B. They both extend in the same direction, which is the opposite direction to the right-angle upstand 60A forming the cutter, and are much smaller than the upstand 60A.

The various parallel S-shape grooves 73 on the body 41 extend its full height, opening at their ends onto the bottom wall 76 and top wall 77.

Figure 18:
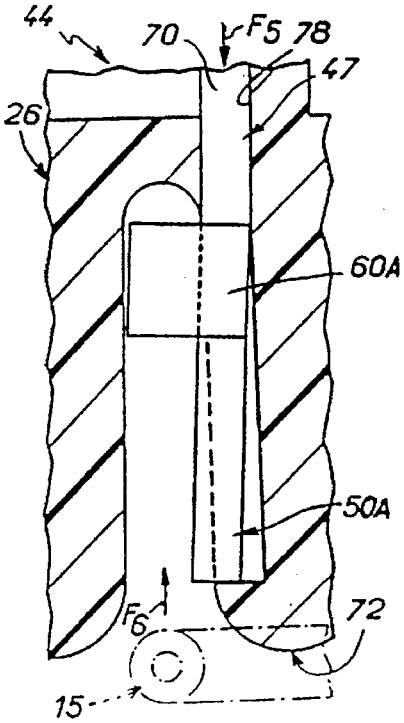
FIG. 18 is a partial view in cross-section on the line XVIII—XVIII in FIG. 17.

At the bottom of each S-shape groove 73 the body 41 has a Z-shape cut-out 78 for insertion of the respective contact 47 from the rear of the body, in the direction of the arrow F5 in FIG. 18.

Figure 14:
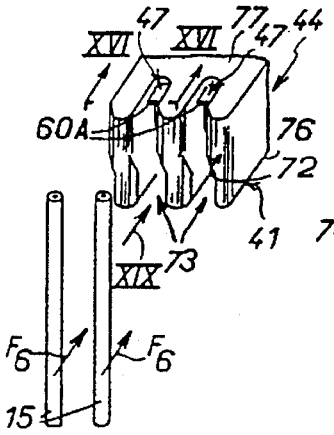
FIG. 14 is a partial perspective view of another connector of the invention.
Figure 15:
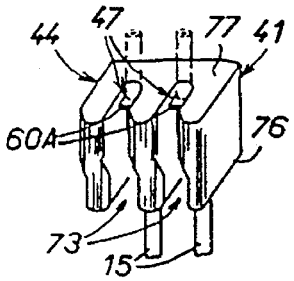
FIG. 15 is a partial perspective view analogous to FIG. 14, after insertion of electrical conductors.
Figure 16:
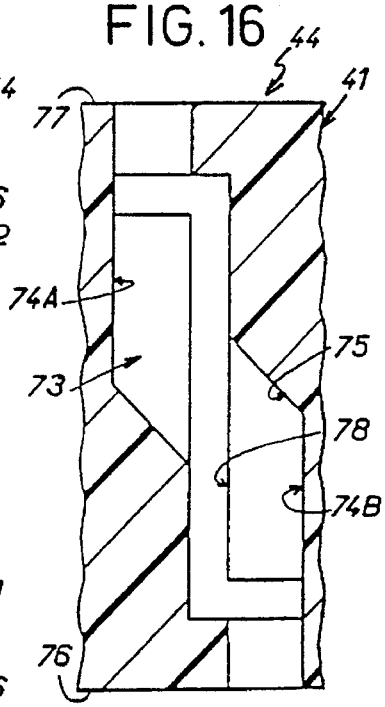
FIG. 16 is a partial view of the connector body only, without its contacts, to a larger scale and in cross-section on the line XVI—XVI in FIG. 14.
Figure 17:
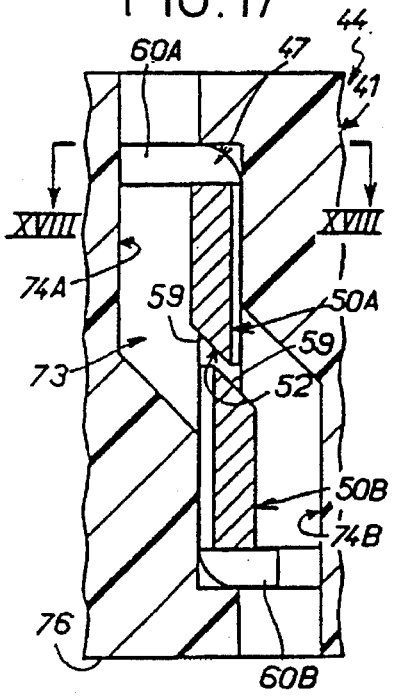
FIG. 17 is a partial view in cross-section analogous to FIG. 16, with the contact present but before insertion of an electrical conductor.
Figure 19:
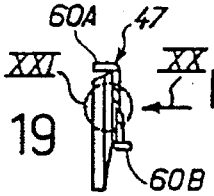
FIG. 19 is an end view of a contact as seen in the direction of the arrow XIX in FIG. 14 and to substantially the same scale as FIGS. 14 and 15.

The opening of each S-shape groove 73 onto the wall 72 is preferably rounded or bevelled, at least locally, to facilitate the insertion of the electrical conductors 15, in the direction of the arrows F6 in FIGS. 14 and 18.

In each of the S-shape grooves 73 the two arms 50A, 50B of the contact 47 bear on respective facing end portions of the respective flanks 74A, 74B of the S-shape groove 73, i.e. on the inside end portions which are substantially in alignment. Each of the right-angle upstands 60A, 60B of the arms 50A, 50B extends transversely in the groove, towards the outside end portions of the flanks, which are farther apart.

In practice the right-angle upstand 60A forming the cutter covers all of the width of the S-shape groove 73 while the right-angle upstands 60B forming the wire-stops cover only part of the width of the groove.

Each electrical conductor 15 is inserted individually from the front into the S-shape groove 73 of the body 41, in the direction of the arrows F6 in FIGS. 14 and 18, and forced into the slot 52 of the contact 47 in the S-shape slot 73.

If required, this insertion can be facilitated by using a tool (not shown) with a cutting edge having a slit in the middle of similar configuration to the S-shape grooves 73 to push on the electrical conductor 15.

Figure 22:
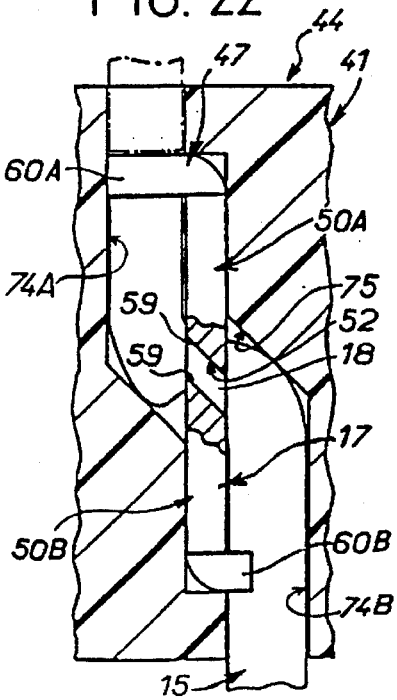
FIG. 22 is a locally cutaway partial view in elevation and in cross-section analogous to FIG. 17, after insertion of an electrical conductor.

At the end of this insertion the electrical conductor 15 has been locally bared by the contact 47 at the slot 52 in the latter, as shown in FIG. 22, with its conductive core 18 in contact with the lips 59 of the slot 52. It is therefore pressed against one side of one arm and the opposite side of the other arm by the widest apart outside portions of said branches 74A, 74B, on opposite sides of the slot 52 through which it passes.

At the same side as the bottom wall 76 of the body 41 it is held between the right-angle upstands 60B forming wire-stops. On the opposite side, and therefore on the exit side, i.e. on the same side as the top wall 77 of the body 41, for example, as shown diagrammatically in chain-dotted outline in FIG. 22, it is cut by the right-angle upstand 60A covering the corresponding end of the S-shape groove 73 and forming the cutter. It is pressed against one side of one arm and the opposite side of the other arm by the outside flanks of said branches 74A, 74B, on opposite sides of the slot 52 through which it passes.

FIGS. 23 to 26 show a variant of the embodiment of the connector of the invention described with reference to FIGS. 14 to 22.

This variant of the connector is designated by the reference 84.

As before, it has an insulative body 81, at least one insulation displacement contact 87 and shaping means described below for pressing the conductor (not shown) against the contact. In practice the body houses a plurality of parallel contacts 87.

The contact 87 has two arms 80A, 80B delimiting between them an insulation piercing slot 82 and defining an entry Vee for the conductor at the end of the slot. It is made by cutting and bending a flat blank.

The arms 80A, 80B are attached to a foot 80 beyond the slot. In this embodiment of the invention the slot has a lateral protrusion 80C which is cut and bent to form a contact resiliently pressed against another identical contact 87' with which it is in a head-to-tail arrangement, as shown in part in chain-dotted outline in FIG. 25. This other contact can be part of another connector 84' similar to the connector 84 and partially nested in it.

The two lips 89 of the slot 82 are oblique to the plane of the arms and substantially parallel to each other in a face-to-face arrangement.

The contact 87 has two right-angle upstands 90A and 90B. These two right-angle upstands are substantially identical but extend in opposite directions. They extend the length of the arms, along the edges opposite those delimiting the slot and slightly beyond these edges, over part of the length of the foot 80. An end notch 91A, 91B on each right-angle upstand 90A, 90B reduces its width in the end part of each arm. A wide punched boss substantially in the middle of each right-angle upstand defines an abutment lug 92A, 92B projecting obliquely from the inside surface of the right-angle upstand to hold the contact in place in the insulative body.

The insulative body 81 has a groove 83 for mounting each contact and providing access to its slot for connecting a conductor (not shown) and in practice includes a plurality of parallel grooves for the various contacts. The grooves 83 are open along one side of the insulative body and give onto two opposite other sides. They extend to a depth in the insulative body substantially equal to the length of the arms and the slot. They extend differently in the body for the foot 80 of each contact and for access to the lateral protrusion on the foot, towards the side opposite that onto which the groove 83 opens.

The parallel grooves 83 are each delimited between two flanks 84A, 84B in face-to-face relationship in the insulative body.

Unlike the grooves of the previous embodiment of the invention (FIGS. 14 to 22), the grooves 83 are obliquely disposed in the body.

The contact 87 extends substantially from one end portion to the other of its groove 83 and assumes a transverse position in the body, as in the previous embodiment of the invention. The two right-angle upstands cover the two end portions of the groove, totally in their wider part and partly in their narrower part. These right-angle upstands are parallel to the end faces onto which the ends of the grooves open. They stiffen the contact to facilitate connection of the conductor.

To retain the contact in this arrangement the flank 84A has a substantially S-shape portion 85A in one of the near terminal portions of the groove and the other flank 84B has a parallel substantially S-shape portion 85B in the other near terminal portion of the groove. The middle parts of the two S-shape portions 85A and 85B are plane, parallel to each other and transverse to the faces of the body onto which the grooves open and give at their ends. They are spaced from each other along the length of the groove and spaced apart transversely by the thickness of the contact. They provide bearing surfaces for the arms 80A and 80B of the contact whose faces which are the outside faces with reference to the right-angle upstands on the arms are partly received against them. The two end parts of each substantially S-shape portion 85A, 85B on either side of this middle portion form two transitions on the flank 84A, 84B. These transitions are parallel and either plane or (as shown here) slightly arcuate.

The two arms 80A, 80B of the contact 87 therefore bear over part of their length against the two substantially S-shape portions 85A and 85B of the flanks 84A and 84B, respectively, and extend freely to either side in the groove. The slot 82 is centred between the substantially S-shape portions 85A and 85B and in the groove 83.

Excluding each of the substantially S-shape portions 85A, 85B on the flanks, it is these flanks oblique to the contact which press the conductor against both the arms 80A, 80B on either side of the slot 82 and on one side of one arm and the opposite side of the other arm. Each conductor is clamped by the narrow end part of the right-angle upstands 90A, 90B. Its end which projects out of the connector is cut off using a cutting tool, the wide part of the right-angle upstand on this side constituting a fixed counter-blade.

Figure 23:
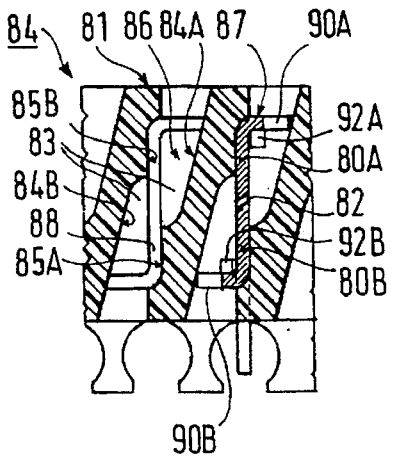
FIG. 23 is a partial view in cross-section of a variant of the FIG. 17 embodiment of the invention.
Figure 24:
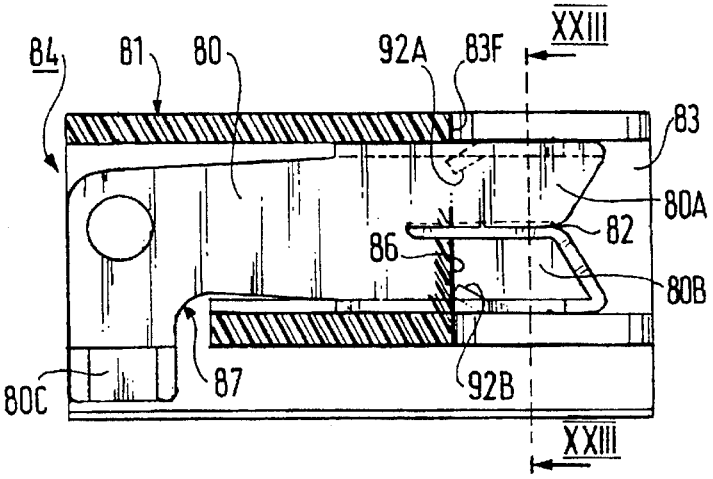
FIG. 24 is another view of the FIG. 23 embodiment of the invention, FIG. 23 being a view in vertical cross-section on the line XXIII—XXIII in FIG. 24.
Figure 25:
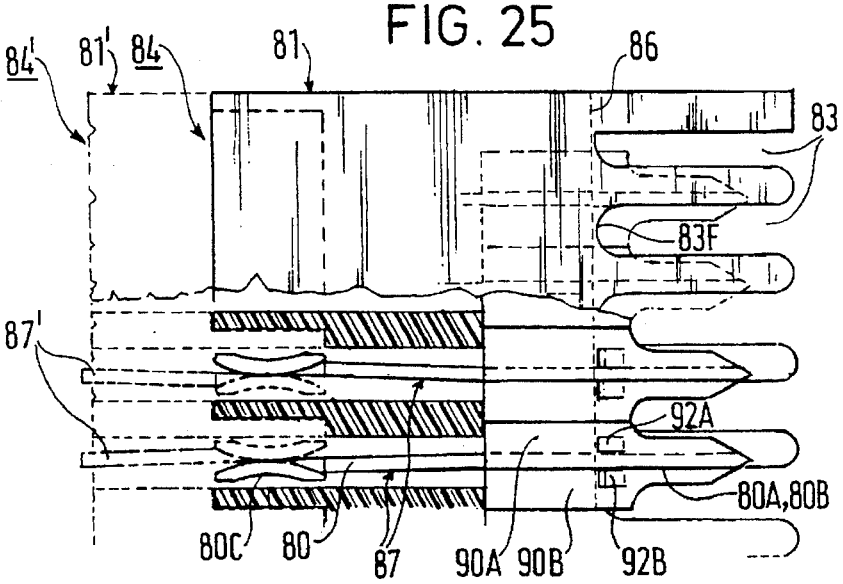
FIG. 25 is a side view partly in cross-section of the FIG. 23 embodiment of the invention.

The inside part 86 of the insulative body defines the position of the rounded back 83F of each Groove 83 and provides a bearing surface for the two punched lugs 92A and 92B on the contact. It is cut by a series of spaced parallel Z-shape through-cuts 88, as shown in FIG. 23 in which one groove has no contact fitted into it. These cuts receive the foot 80 and the wide parts of the right-angle upstands 80A and 80B partly flanking the foot.

FIGS. 27 to 32 show a variant of the embodiment of the connector of the invention shown in FIGS. 14 to 22 or FIGS. 23 to 26.

This connector 104 has an insulative body 101, parallel identical contacts 107 mounted in the body and means for pressing the conductors (not shown) against the contact to which each is connected.

The contact 107 has two arms 110A and 110B delimiting between them an insulation piercing slot 112 having an entry Vee at the end of the arms for the conductor. It also has a foot 110 on the opposite side to the two arms, which are joined to it, and a lateral protrusion 110C on one side only of the foot. It also has an intermediate portion 114 between the foot and the two arms.

The lips of the slot are oblique.

Two upstands 120A and 120B in opposite directions are provided along the two arms and the intermediate portion 114. A notch 121A, 121B on the end portion of each upstand reduces its width in the end part of each arm and ends at a bevel 125A, 125B on the end of the arm. A punched boss is provided on the wide part of each upstand and forms an oblique abutment lug 122A, 122B on its inside surface.

The essential differences compared to the previous embodiments of the invention shown in FIGS. 14 to 22 and FIGS. 23 to 26 are as follows:

The two arms 110A and 110B are substantially coplanar but they and the joining part are oblique to the foot. This is achieved by a local deformation 126A, 126B on each side of the foot about its longitudinal axis through the slot 112, to twist the arms and the joining part into this oblique orientation relative to the foot.

Figure 27:
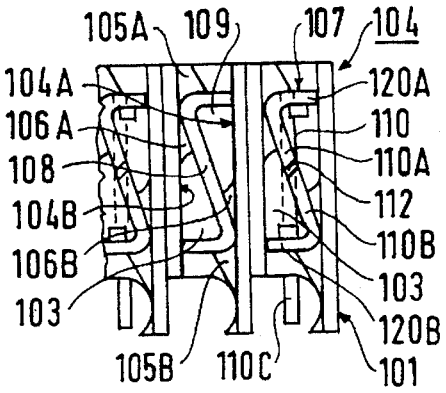
FIG. 27 is a partial top view of a variant of the FIG. 17 and 23 embodiments of the invention.
Figure 30:
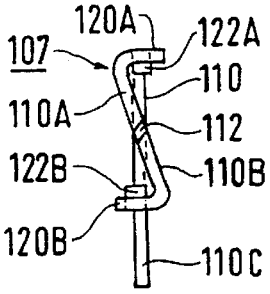
FIGS. 30, 31 and 32 are front, end and side views of this variant of the embodiment of the invention shown in FIGS. 27 to 29.

The upstands 120A and 120B are not right-angle upstands, being at an acute angle to the respective arms so that the contact is Z-shape at this point, the Z being inverted in FIGS. 27 and 30.

The insulative body 101 has for each contact 107 a groove 103 open along one side of the body. The grooves for the various contacts are parallel and open onto opposite sides of the body. They extend into the depth of the body to a distance substantially equal to the length of the arms and the slot 112.

Figure 28:
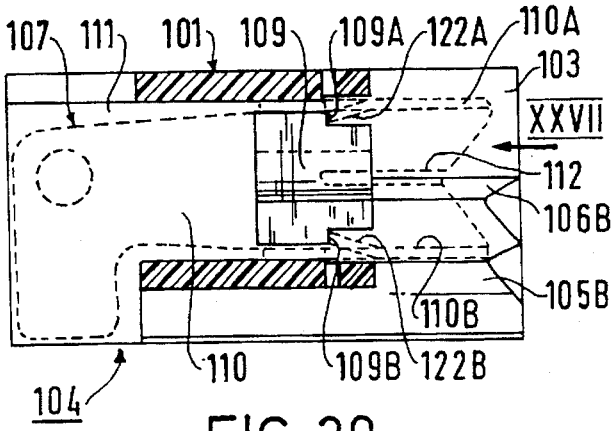
FIG. 28 is a view in vertical cross-section of FIG. 27 which is a view in the direction of the arrow XXVII in FIG. 28.
Figure 29:
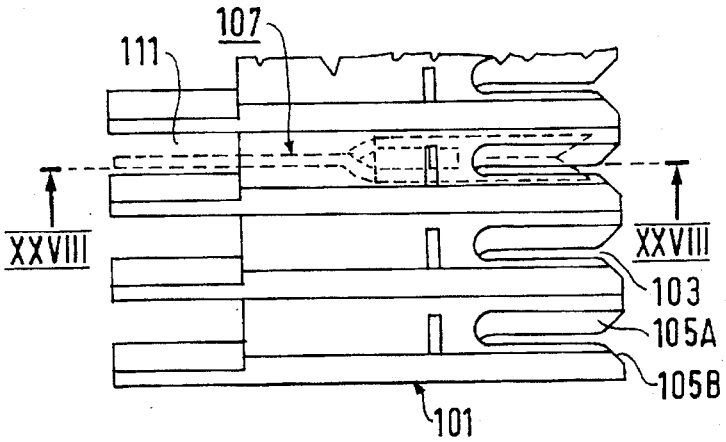
FIG. 29 is a partial side view of FIG. 28 which is a view in cross-section on the line XXVIII—XXVIII in FIG. 29.

As shown in FIG. 27, in which one of the grooves has no contact in it, and FIG. 28, the grooves 103 communicate individually with Z-shape cut-outs 108 in the middle part 109 of the body and each opening into the back of one of the grooves 103. The punched lugs 122A and 122B abut against this middle part which has notches 109A and 109B on its opposite sides. The Z-shape cuts 108 communicate with grooves 111 opposite the grooves 103.

Unlike the grooves in the previous embodiments of the invention as shown in FIGS. 14 to 22 and FIGS. 23 to 26, the grooves 103 are straight on the respective side of the insulative body 101. The two arms 110A and 110B extend substantially from one end portion of each groove to the other and assume an oblique position in the grooves. The slot 112 is centred in the groove and extends in its depthwise direction. The narrow parts of the upstands 120A and 120B partly cover the end portions of each groove 103 and the wide parts cover them totally, the transition between the wide part and the narrow part being substantially at the level of the bottom of each groove.

To hold each contact 107 in its groove 103 the two facing flanks 104A and 104B which delimit the groove are essentially straight but have localized deflectors 105A and 106A, 105B and 106B projecting into the groove. The two deflectors on one flank are in one end portion of the groove while those on the other flank are in its other end portion. The two deflectors on each flank are substantially contiguous and define between them and towards the central portion of the groove a substantially S-shape local protuberance. They hold between them the projecting edge of the bend of the upstand on each arm, together with the adjoining parts of the upstand and the arm on respective opposite sides of the bend. The slot 112 and the other part of each arm are therefore unimpeded in the middle portion of the groove, between the two deflectors on one flank and those on the other flank.

The straight portions of the flanks therefore press the conductor against the contact on either side of the slot 112, forming on one side of one arm and the opposite side of the other arm a narrow space for the conductor passing through the slot.

Figure 26:
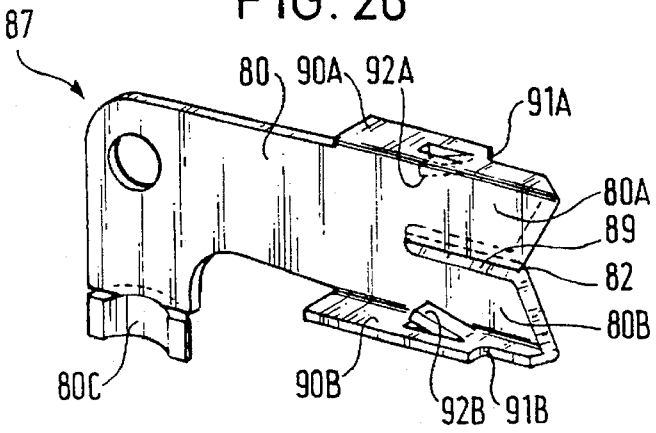
FIG. 26 is a perspective view of the contact from the embodiment of the invention shown in FIGS. 23 to 25.
Figure 32:
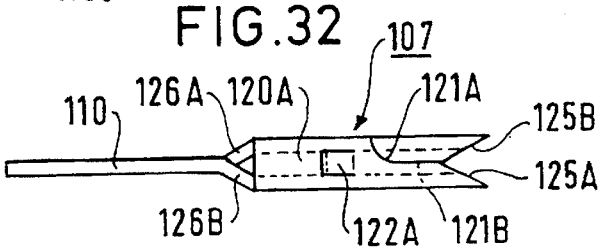

In a variant of any of FIGS. 20, 26 and 32, the contact can be a double contact, i.e. two contacts in one piece and with no foot on either contact, which are preferably in a head-to-tail arrangement. The connector body is adapted accordingly and symmetrical about the median transverse plane of the double contact.

Figure 31:
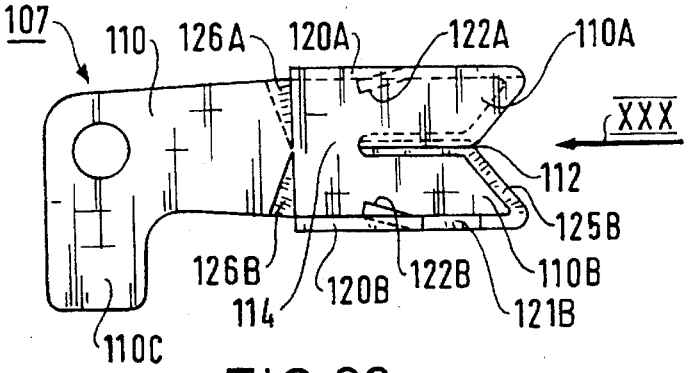
Figure 33:
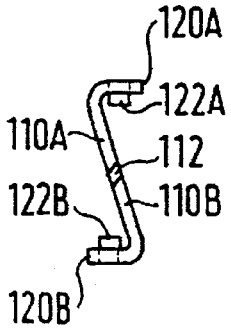
FIGS. 33 and 34 are front and end views of the contact of a double contact derived from that shown in FIGS. 30 and 31.
Figure 34:
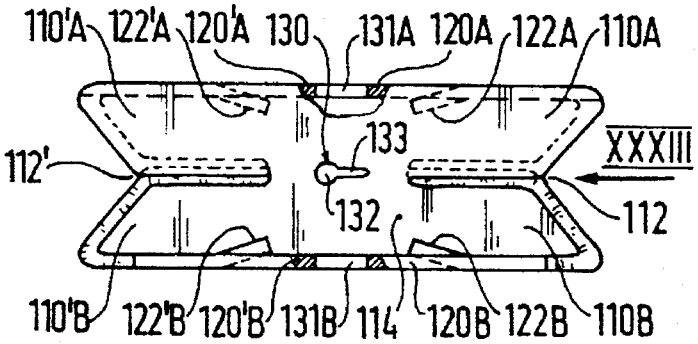
Figure 35:
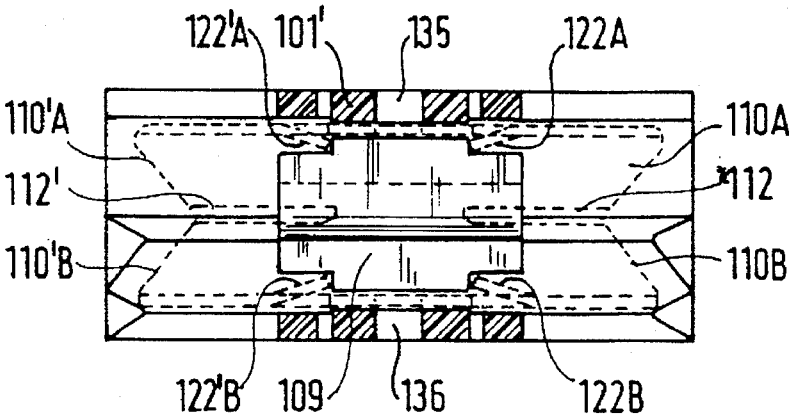
FIG. 35 is a view in cross-section of a connector of the invention fitted with at least one double contact as shown in FIGS. 33 and 34 and derived from the connector as shown in FIG. 28.

This variant is shown in FIGS. 33 and 34, in the case of the double contact derived from the contact of FIGS. 30 and 31, and in FIG. 35, in the case of the connector fitted with at least one double contact of this type, FIG. 35 being in turn derived from FIG. 28.

In FIGS. 33 to 35, reference numbers used previously in FIGS. 30, 31 and 28 denote the same parts. They are "primed" to indicate the symmetry relative to the median transverse plane of the double contact, i.e. relative to the joining part 114 on the double contact and the inside part 109 of the insulative body.

The double contact and the connector fitted with it are therefore not described further.

Referring to FIG. 34, the double contact has three holes 130, 131A and 131B substantially aligned with the transverse axis of symmetry and through the joining part and the two upstands. These holes can receive a relatively rigid uninsulated conductive wire threaded into the contact and connected to it in this way.

The holes facilitate insertion of the wire and hold it in place. They are defined by a circular shape 132 for the wire entry which opens onto an elongate and narrower slot 133 (only that for the hole 130 is shown).

There are two corresponding holes 135, 136 in the connector body. The two holes shown on either side of the holes 135 or 136 are connected with molding the connector body.

An analogous disposition can naturally be chosen for the contact of FIGS. 30 through 32, through its two upstands and the part joining it to the foot and in corresponding relationship in the connector body fitted with these contacts.

I claim:

1. A connector including an insulative body and at least one flat insulation displacement contact mounted in a groove in said body, wherein each contact has an insulation piercing slot for connecting a conductor, said slot being defined between two substantially coplanar arms, and wherein said contact comprises means (25, 33, 73, 83, 103) on opposite sides of said slot for shaping the conductor (15) associated with each contact (17, 47) for connecting the conductor in the slot (22, 52, 82, 112) and pressing the conductor against opposite major faces of said contact, on a first face in the case of one of the arms (20A, 50A, 80A, 110A) and on the opposite face in the case of the other arm (20B, 50B, 80B, 110B).

2. A connector according to claim 1, wherein the insulation piercing slot of each contact is delimited by two offset lips transverse to the plane of the contact arms.

3. A connector according to claim 1, wherein the insulation piercing slot of each contact is delimited by two lips slanted relative to the plane of the contact arms.

4. A connector as recited in claim 1, wherein, when the conductor is pressed against said opposite faces of said contact, the conductor assumes a substantially S-shaped configuration.

5. A connector as recited in claim 1, wherein, when the conductor is pressed against said opposite faces of said contact, the conductor is bent in opposite directions on opposite sides of the slot.

6. A connector according to claim 1, wherein said means (25) for shaping the conductor include on said contact (17) two flats for engaging the conductor in the slot (22) substantially symmetrically inclined on opposite sides of said arms (20A, 20B) and extending the respective arm at the end of said slot to receive and locate the conductor between them along a line (L1) substantially perpendicular to the direction (D1) of said slot.

7. A connector according to claim 6, wherein said flats (25) are parts of two substantially semicylindrical deformations (26) substantially at the ends of and projecting from respective ones of said arms (20A, 20B) having generatrices transverse to the slot and a concave side facing towards the plane of said arms and defining a passage (27) perpendicular to the direction of the slot for receiving the conductor to be connected in the slot.

8. A connector including an insulative body and at least one flat insulation displacement contact mounted in a groove in said body, wherein each contact has an insulation piercing slot for connecting a conductor, said slot being defined between two substantially coplanar arms, and wherein said contact comprises means (25, 33, 73, 83, 103) on opposite sides of said slot for shaping the conductor (15) associated with each contact (17, 47) for connecting the conductor in the slot (22, 52, 82,112) and pressing the conductor against opposite faces of said contact, on a first face in the case of one of the arms (20A, 50A, 80A, 110A) and on the opposite face in the case of the other arm (20B, 50B, 80B, 110B), wherein said shaping means (33) further include said groove in which said contact (17) is mobile between two flanks (32A, 32B) of said groove from a position of engagement of the conductor between said flats to a position of connection of the conductor in said slot, the two facing flanks (32A, 32B) holding the conductor against said contact during placing of said contact in said connection position.

9. A connector according to claim 8, wherein said body includes an entry channel (36) and a hole (35) in said body (11) opening into each groove along said line (L1) for receiving and locating said conductor between said flats (25) for said position of engagement of said contact in said groove.

10. A connector according to claim 9, wherein said contact (17) is rotatable in said groove (33).

11. A connector according to claim 10, wherein said contact (17) includes a lateral hinge (24) transverse to the direction of said slot.

12. A connector according to claim 11, wherein said contact (17) and another identical contact constitute a double contact sharing said hinge (24).

13. A connector according to claim 11, wherein said contact (17) projects from said body (11) in said engagement position to enable said contact to be placed in said connection position by direct action on it.

14. A connector including an insulative body and at least one flat insulation displacement contact mounted in a groove in said body, wherein each contact has an insulation piercing slot for connecting a conductor, said slot being defined between two substantially coplanar arms, and wherein said contact comprises means (25, 33, 73, 83, 103) on opposite sides of said slot for shaping the conductor (15) associated with each contact (17, 47) for connecting the conductor in the slot (22, 52, 82,112) and pressing the conductor against opposite faces of said contact, on a first face in the case of one of the arms (20A, 50A, 80A, 110A) and on the opposite face in the case of the other arm (20B, 50B, 80B, 110B), wherein said conductor shaping means include said groove (73, 83, 103) in which said contact (17) is fixed and which is long, open, delimited between two facing flanks (74A, 74B; 84A, 84B; 104A, 104B) which are substantially S-shape, at least locally and in a longitudinal direction of the groove, and each adapted to hold a first side of a first arm against a first of said flanks in a first end portion of said groove and the opposite or second side of the second arm against the second flank in the second end portion of said groove and to guide the conductor received in the longitudinal direction of the groove against the second side of the first arm and the first side of the second arm, before its engagement in said slot.

15. A connector according to claim 14, wherein said flanks (74A, 74B) are substantially S-shape over the length of said groove (73) which is also S-shape and each has two substantially parallel opposite end portions joined by a slantwise middle portion between the two end portions.

16. A connector according to claim 14, wherein said flanks (84A, 84B) are substantially S-shape over one end portion of the groove for one flank and over the other end portion of the groove for the other flank.

17. A connector according to claim 16, wherein said groove (83) delimited between said flanks (84A, 84B) is slanted in said body (81) and imparts a straight direction to the arms in the body.

18. A connector according to claim 16, wherein said groove (103) delimited between said flanks (104A, 104B) is straight in said body (101) and imparts a slanted direction to the arms in said body.

19. A connector according to claim 16, wherein each contact (47, 87, 107) has an upstand (60A, 60B; 90A, 90B; 120A, 120B) on each arm over at least part of the length of the edge of the arm facing said slot and bent to an angle of not more than substantially a right angle one way on one of the two arms and the opposite way on the other arm, so that said contact is Z-shape in cross-section at their location.

20. A connector according to claim 19, wherein said contact is a double contact having two aligned slots (112, 112') in opposed relationship and in that the bent upstand (120A, 120'A, 120B, 120'B) on each arm is continuous over the arms on the same side of the two slots.

21. A connector according to claim 19, wherein said body has a Z-shape cut-out (78, 88, 108) in said insulative body and opening onto a back wall of said groove (73, 83, 103).

22. A connector according to claim 21, wherein the bent upstands (90A, 90B; 120A, 120B) have a notch (91A, 91B; 121A, 121B) on their end part at the same end as the ends of the arms and the slot.

23. A connector according to claim 21, wherein said contact includes a foot (70, 80, 110) aligned with said arms beyond said slot and having spring coupling means (80C, 110C) to couple it to another identical contact facing it and oriented in the opposite direction in a head-to-tail arrangement.

24. A connector according to claim 23, wherein said arms (120A, 120B) and said foot (110) are in two non-parallel planes and the direction of said slot is aligned with the axial direction of said foot.

25. A connector according to claim 22, wherein each upstand (120A, 120B) is bent at an acute angle to the arm on which it is formed.

26. A connector according to claim 25, wherein said contact further includes a set of three substantially aligned holes (130, 131A, 131B) through each bent upstand and a part fastening the arms together beyond the slot in corresponding relationship to two further holes (135, 136) opening to the outside through said body.

27. A connector according to claim 26, wherein said three aligned holes (130, 131A, 131B) each have a circular part (132) opening into a narrower elongate slot (133).

* * * * *